US007062995B2

(12) United States Patent
Smith et al.

(10) Patent No.: US 7,062,995 B2
(45) Date of Patent: Jun. 20, 2006

(54) T-CONNECTOR HOLDING TOOL AND METHOD

(76) Inventors: Timothy V. Smith, 90 Narrows Rd., Center Barnstead, NH (US) 03225; Kayley M. Smith, P. O. Box 5631, Manchester, NH (US) 03108

( * ) Notice: Subject to any disclaimer, the term of this patent is extended or adjusted under 35 U.S.C. 154(b) by 0 days.

(21) Appl. No.: 10/757,535

(22) Filed: Jan. 15, 2004

(65) Prior Publication Data

US 2005/0156084 A1 Jul. 21, 2005

(51) Int. Cl.
*B25B 13/06* (2006.01)

(52) U.S. Cl. ..... 81/121.1; 81/177.85

(58) Field of Classification Search ..... 294/19.1, 294/24; 248/52; 81/119, 120, 121.1, 124.2, 81/124.6, 124.7, 124.4, 802, 177.85, 177.2
See application file for complete search history.

(56) References Cited

U.S. PATENT DOCUMENTS

| | | | | | |
|---|---|---|---|---|---|
| 120,304 | A | * | 10/1871 | McBride | 81/119 |
| 906,415 | A | * | 12/1908 | Hallgren | 294/19.1 |
| 1,006,721 | A | * | 10/1911 | Clark | 294/19.1 |
| 1,223,791 | A | * | 4/1917 | Jackson | 439/477 |
| 1,345,027 | A | * | 6/1920 | Rippe | 81/484 |
| 1,408,444 | A | * | 3/1922 | Collins | 81/119 |
| 2,649,824 | A | * | 8/1953 | Maxwell | 81/99 |
| 2,667,375 | A | * | 1/1954 | Cardinal | 294/19.1 |
| 3,039,339 | A | * | 6/1962 | Hanson | 81/177.2 |
| 3,048,139 | A | * | 8/1962 | Duckett | 114/221 R |
| 3,171,386 | A | * | 3/1965 | De Ronde | 119/806 |
| 3,788,169 | A | * | 1/1974 | Nakayama | 81/124.6 |
| 3,988,918 | A | * | 11/1976 | Crees | 72/458 |
| 4,004,476 | A | * | 1/1977 | DeVrou | 81/177.2 |
| 4,962,682 | A | * | 10/1990 | Rose et al. | 81/177.85 |
| 5,333,821 | A | | 8/1994 | Lee | 248/52 |
| 5,603,543 | A | * | 2/1997 | Ratte | 294/11 |
| 5,772,160 | A | * | 6/1998 | Gordon | 248/68.1 |
| 2004/0035260 | A1 | * | 2/2004 | Adkison | 81/124.2 |

FOREIGN PATENT DOCUMENTS

| | | |
|---|---|---|
| JP | 54-006126 | 1/1979 |
| JP | 08-300267 | 11/1996 |

* cited by examiner

*Primary Examiner*—A. Joseph Wujciak
(74) *Attorney, Agent, or Firm*—Richard C. Litman

(57) ABSTRACT

A T-connector holding tool is a tool for immobilizing or applying a torque to a T-connector. The tool has an elongated handle portion and a head portion fixed to the handle portion. The head portion includes a pair of rigid claws, each including an interior surface sized to capture a corresponding one of two aligned nuts of the T-connector. When applying a torque to the third nut of a T-connector, the T-connector is immobilized by capturing the aligned first and second nuts and applying a counteracting torque to the T-connector, the counteracting torque being opposite the torque applied to the third nut.

5 Claims, 6 Drawing Sheets

T-CONNECTOR HOLDING TOOL AND METHOD

BACKGROUND OF THE INVENTION

1. Field of the Invention

The present invention relates to a tool for the pipe fitting trades, particularly in gas pipe plumbing. In particular, the invention relates to a tool for holding a T-connector in position when torquing the perpendicular third nut on the T-connector to prevent damage to the other connections.

2. Description of the Related Art

When plumbing gas lines, e.g., propane or natural gas, T-connectors with compression or flared fittings are often used to divide gas flow from a source to two or more appliances. The T-connectors are generally made of brass and include three nuts for compression fit of three copper lines. Each copper line must be flared before tightening the nut down on the T-connector. For purposes of the present application, the first and second nut will be the two that are in-line, or coaxial, while the third nut will be perpendicular to the first two, thus forming the downwardly extending leg of the "T".

A problem occurs when torquing (either tightening or loosening) the third nut while one or both of the first and second nuts are attached to copper line. Torque applied to the third nut is transmitted to the T-connector body, which places strain on the first and/or second connections. An opposite torque should be applied to the T-connector itself to balance and counteract the torque applied to the third nut to prevent damage to the flared ends of the copper lines at the first and/or second connections. Past practice has been to use an adjustable wrench extending at an odd angle from the top of the "T" in an attempt to hold the T-connector in place while torquing the third nut. Unfortunately, it is very difficult to prevent a significant net torque against the T-connector using an adjustable wrench on the T-connector itself. If the net torque is too great, damage to the flared ends of the copper pipe could result, in which case a leak can occur.

It has not, to the inventors' knowledge, heretofore been recognized that many such leaks can be prevented if the T-connector is properly immobilized during the torquing operation. Neither has there been a satisfactory tool available to immobilize the T-connector when torquing the third nut by applying a counteracting torque to the T-connector.

U.S. Pat. No. 5,333,821, issued Aug. 2, 1994 to Lee, discloses a fan pipe holder for a soldering iron. The device comprises a plurality of opposed ribs connected by spine. The ribs and spine are bent into a desired configuration from a single sheet of flat stainless steel. This device is not suitable for holding a T-connector, since it is not sized to fit over the first two nuts of a T-connector, is not stiff enough to immobilize the T-connector, and does not include a handle.

Japanese Patent No. 54-6,126 teaches a rain-pipe holder for supporting rigid cylinders on either side of soft bellows. This device is also not suitable since it not sized to fit over the first two nuts of a T-connector, nor is it stiff enough to immobilize the T-connector when torquing the third nut. In addition, it does not include a handle.

Japanese Patent No. 08-300,267 discloses a pipe holder used when making a coaxial connection. This device uses spring-loaded clips to maintain two pipes in alignment when making a connection. It is not suitable for immobilizing a T-connector. The clips would not be strong enough to maintain a firm hold on the T-connector, even if they were positioned close enough together to both engage the T-connector. Furthermore, the handle extending between the clips does not enhance a person's leverage over what would be available simply by grasping the T-connector itself.

None of the above inventions and patents, taken either singly or in combination, is seen to describe the instant invention as claimed. Thus a T-connector holding tool and method solving the aforementioned problems is desired.

SUMMARY OF THE INVENTION

The T-connector holding tool of the present invention is a hand tool for immobilizing or applying a torque to a T-connector. The tool has an elongated handle portion and a head portion fixed to the handle portion. The head portion includes a pair of rigid claws, each including an interior surface sized to capture a corresponding one of two aligned nuts of the T-connector. When applying a torque to the third nut of a T-connector, the T-connector is immobilized by capturing the aligned first and second nuts and applying a counteracting torque to the T-connector, said counteracting torque being opposite the torque applied to said third nut.

Accordingly, it is a principal object of the invention to prevent leaks at T-connector connections.

It is another object of the invention to prevent leaks at T-connector connections by immobilizing the T-connector while torquing the third nut.

It is a further object of the invention to immobilize the T-connector by capturing the first and second nuts in a pair of claws.

Still another object of the invention is to immobilize the T-connector by allowing a person to apply a counteracting torque to the T-connector on an axis that is coincident with the axis of the third nut.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The T-connector holding tool of the present invention is useful in immobilizing a T-connector when torquing the third nut thereof. The tool will now be described in detail with reference to FIGS. 1–4. A T-connector is a connector having three pipe connections generally used for splitting off a flow of fluid. For the purposes of discussion, a first and second connection are in-line or coaxial, forming the top of the "T" shape of the T-connector. The third connection is on a stem extending perpendicularly from the axis of the first two connections, forming the depending leg of the "T".

Figure 1:
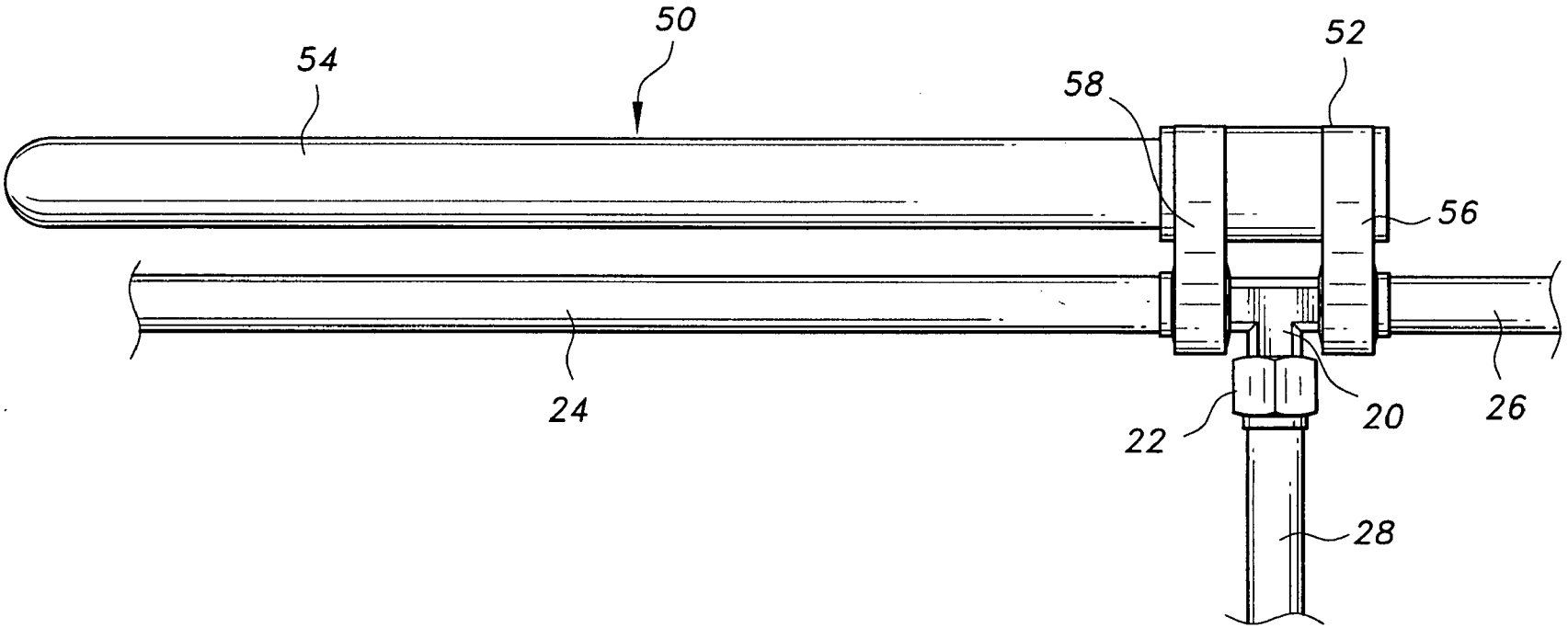
FIG. 1 is an environmental, elevational view of a T-connector holding tool according to the present invention.

FIG. 1 shows a T-connector 20 that includes a body with three compression fittings disposed in the shape of a "T", as described above. When torquing third nut 22 of T-connector 20, it is commonly required that some counteracting torque be applied to the body of T-connector 20, to prevent damage to flared ends (not shown) of copper pipes 24, 26 fit to the first and second nuts of T-connector 20.

T-connector holding tool 50 can be used to immobilize, or apply a counteracting torque, to T-connector 20 when torquing third nut 22, thereby ensuring no damage to the remaining connecting pipes 24, 26 and reducing the overall potential for leaks.

Handle 54 is placed so that it extends parallel to pipes 24 and 26. Head 52 is attached to handle 54. Head 52 includes two pairs of rigid claws 56, 58. Claws 56, 58 extend on either side of the first and second nuts of T-connector 20. Thus, when a lateral force is applied to handle 54, a torque is generated in T-connector 20 that is coincident with the axis of third nut 22.

Figure 2:
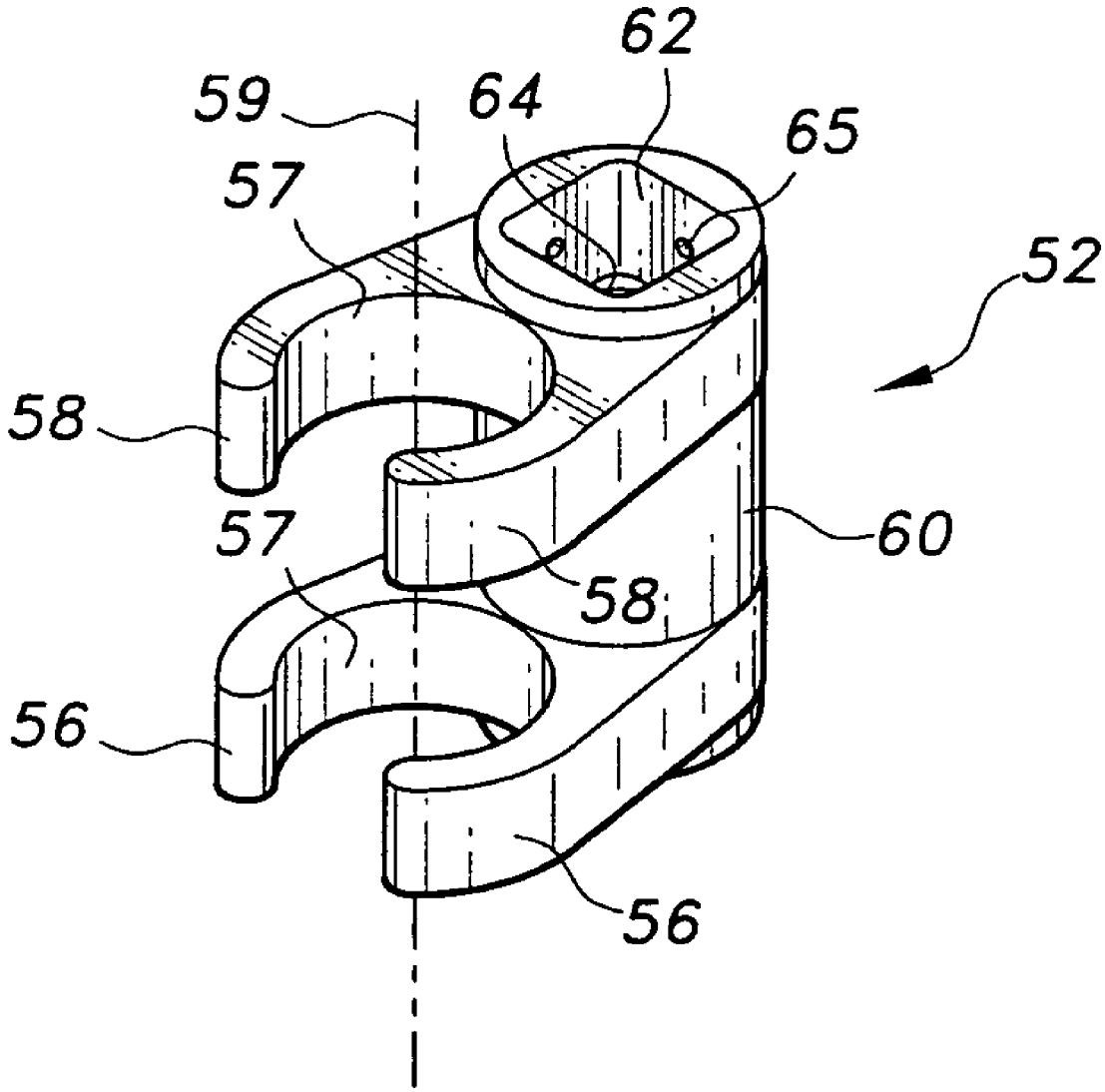
FIG. 2 is a perspective view of an interchangeable head of the T-connector holding tool shown in FIG. 1 as seen from the bottom of the head.
Figure 3:
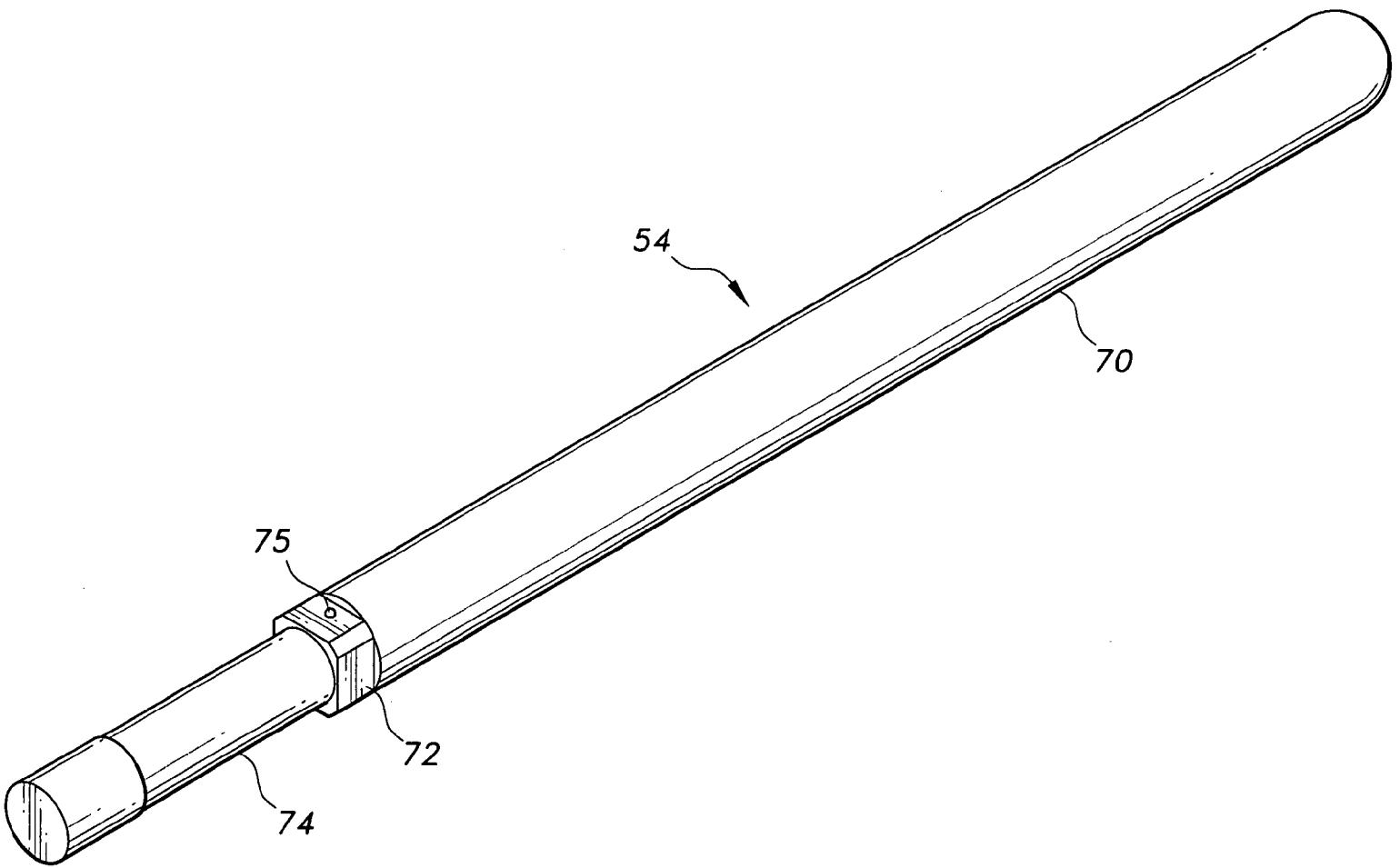
FIG. 3 is a perspective view of a handle of the T-connector holding tool of the present invention, matable with the interchangeable head of FIG. 2
Figure 4:
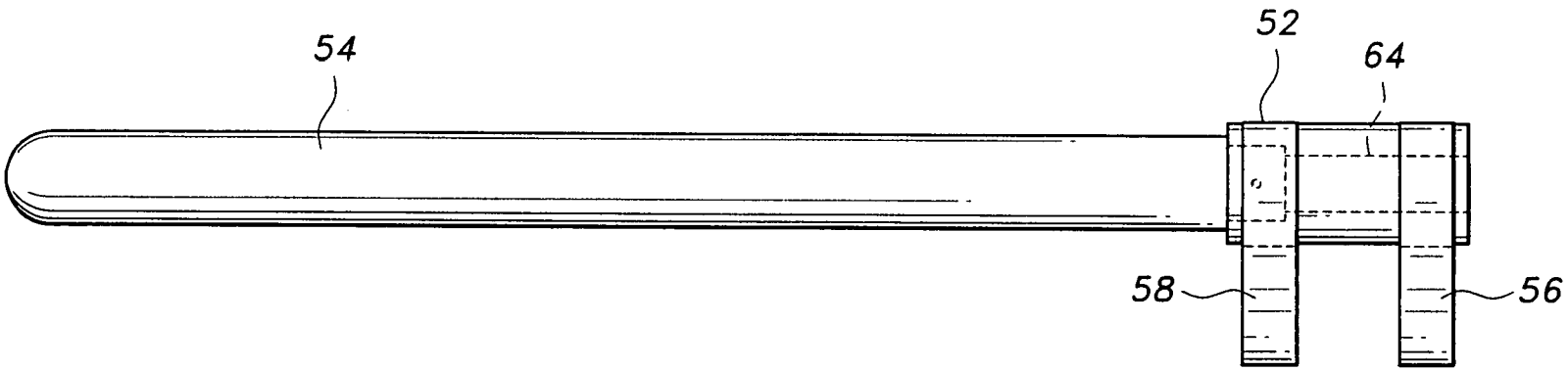
FIG. 4 is an elevational view of the T-connector holding tool according to the present invention.

The structure of head 52 will now be described in more detail with reference to FIGS. 2 and 4. Head 52 includes a cylindrical body 60 extending between a claw 56 and a claw 58. Each claw 56, 58 is formed from two jaws rigidly connected to body 60 and has a cylindrical inner surface 57. The claws 56 and 58 are in parallel, spaced relation, so that the cylindrical inner surfaces 57 define an imaginary cylinder having axis 59. Each cylindrical surface extends more than halfway around the circumference of the imaginary cylinder. Axis 59 extends parallel to body 60, and the radius of cylindrical surface 57 is chosen to be slightly larger than the corner-to-corner diameter of the first and second nuts of the T-connector. Thus, each claw 56, 58 is shaped and positioned to capture one of the first and second nuts of the T-connector. By "capture" it is meant that lateral movement, i.e., translation in a direction other than along its axis, is prevented. For each size T-connector (each used for different pipe diameters), there will be a different size head 52. Head 52 may be thought of as two parallel, spaced apart crow's foot wrenches joined together by a cylindrical body, except that claws 56 and 58 have a smooth, arcuate bore instead of having hexagonal points defined therein adapted for gripping the nut. Of course, claws 56 and 58 may have hexagonal points defined therein if so desired.

Head 52 includes hole 64 extending through body 60 and a socket portion 62 for engaging handle 54 as will now be described. Head 52 can be detached and reattached to handle 54 using a snap connection. Handle 54, shown by way of example in FIG. 3, includes a handle portion 70 and a lug 74 extending longitudinally from and coaxially with handle portion 70. Handle portion 70 may be about eight inches long (20 cm) and lug 74 may be about 3 inches long (8 cm). Handle 54 also includes a square drive snap connector 72, e.g., a ½ inch square drive, having a spring-loaded ball bearing 75 extending partially therefrom in the manner well known and understood in the art of hand tools. Spring-loaded ball bearing 75 engages one of detents 65 formed inside the socket 62 at the bottom end of head 52. Thus, head 52 is attached to handle 54 simply by inserting lug 74 of handle 54 into hole 64 formed in head 52 until snap connector 72 snaps into place, i.e., spring-loaded ball bearing 75 engages one of detents 65. The top end of lug 74 is cylindrical, sliding into a cylindrical bore defined in the top end of head 52.

Figure 6:
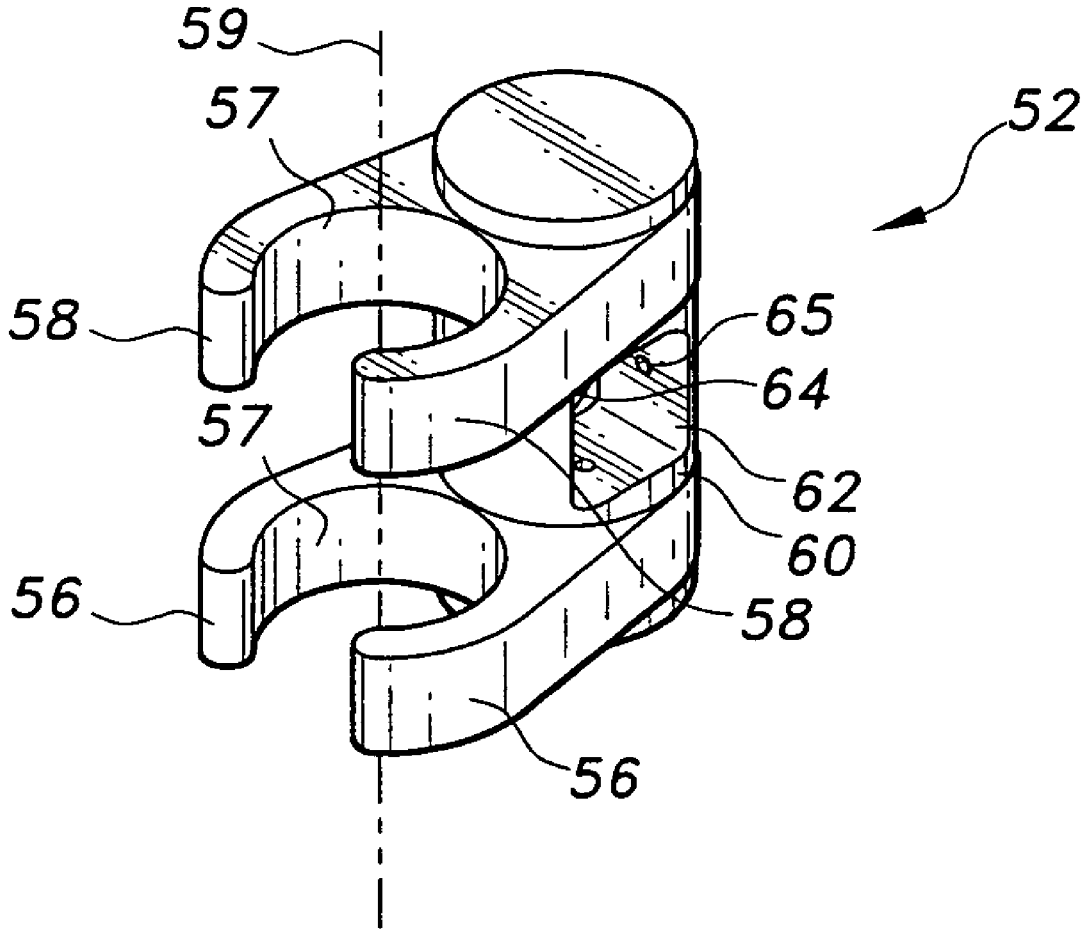
FIG. 6 is a perspective view of an alternative embodiment of the interchangeable head shown in FIG. 2.

FIG. 6 shows an alternative embodiment of head 52 wherein socket portion 62 extends transversely through cylindrical body 60. Thus, when inserted in socket 62, handle 54 will extend generally perpendicularly axis 59 but not in the same plane.

Handle 54 and head 52 are made of machined aluminum or aluminum alloy, but of course other known materials and manufacturing methods that are well known in the hand tool industry are contemplated. However, it is desirable that T-connector holding tool 50 be rigid and durable. For example, steel, stainless steel, and/or lightweight composite materials may be used in the production of T-connector holding tool 50. Handle portion 70 of handle 54 may be dipped in or otherwise coated or covered with elastomeric material (not shown) to provide an improved grip and comfort. Handle portion 70 may be knurled, etched, or finished in another known fashion to improve the grip and aesthetics.

An additional head 52 is manufactured for each commonly sized T-connector. T-connectors are most commonly are made for quarter-inch pipe, three-eighths inch pipe, one-half inch pipe, and five eighths inch pipe. It is contemplated that a head 52 be produced for each size T-connector. By providing interchangeable heads, considerable space can be saved in the technician's toolbox. However, it is of course also within the scope of the invention that each size head 52 have a handle 54 such that handle 54 and head 52 are produced as a single contiguous piece of metal or other rigid durable material.

Figure 5:
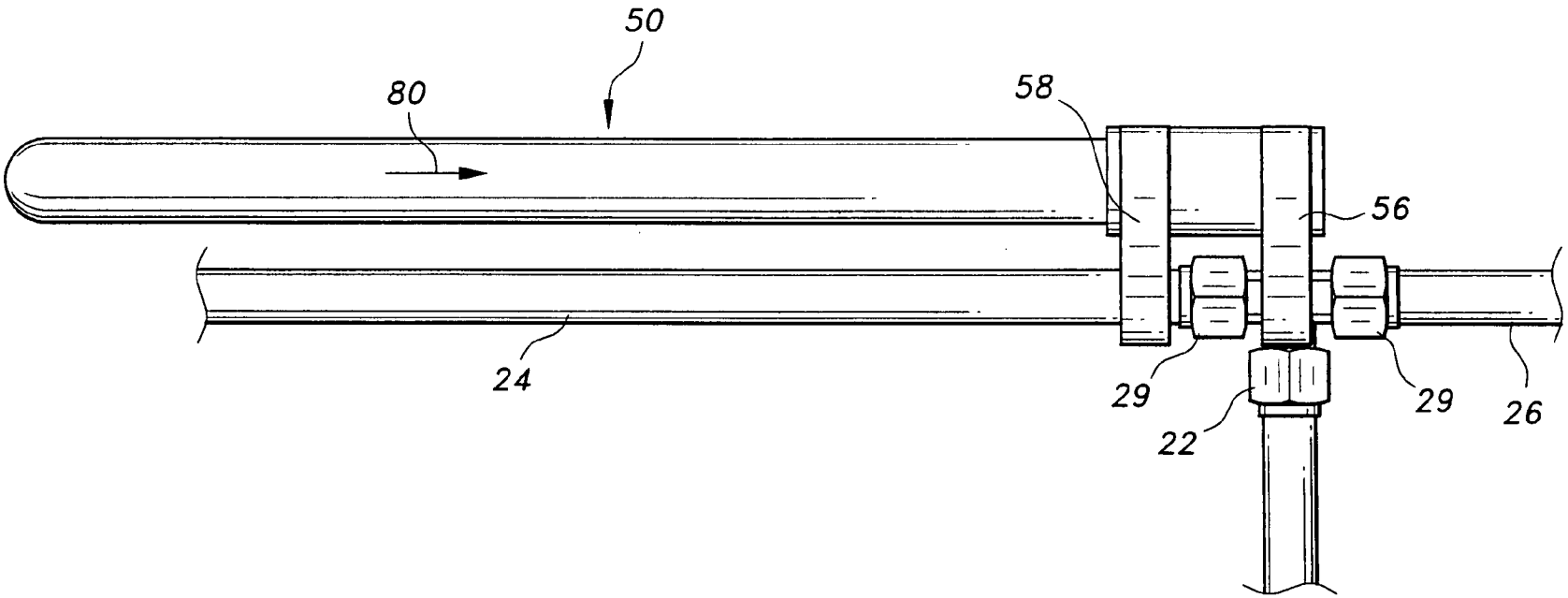
FIG. 5 is an environmental, elevational view showing an intermediate step in the operation of the T-connector holding tool.

Referring now to FIGS. 1 and 5, a short explanation of the use of T-connector holding tool will now be described. Because cylindrical surface 57 extends more than halfway around the circumference of the (imaginary) cylinder it defines, claws 56, 58 cannot slide laterally over first and second nuts 29 (FIG. 5). As shown in FIG. 5, T-connector holding tool 50 is first placed in the intermediate position shown, with one of claws 56, 58 placed between first and second nuts 29 and the other of claws 56, 58 placed adjacent T-connector 20. Then, T-connector holder 50 is slid axially in the direction of arrow 80 until it is in the position shown in FIG. 1, with each of claws 56 and 58 snuggly encircling each of first and second nuts 29.

Now, the technician, using a wrench to torque (i.e., tighten or loosen) third nut 22, uses handle 54 of T-connector holding tool 50 to balance torque transferred from third nut 22 to T-connector 20. Handle 54 can be held relative to pipe 24, or the technician can simply utilize handle 54 to push against as leverage against the handle of the wrench (not shown) used to torque third nut 22. When a lateral force is applied to handle 54, opposite lateral forces are applied to each of the first and second nuts of T-connector 20, thereby providing a net torque against T-connector 20 that is coincident with the axis of the third nut. Thus, it is possible to apply a balancing or counteracting torque when torquing the third nut.

Various modifications of the instant tool are envisioned. For example, cylinder 60 may include one or more holes to permit handle lug 74 of handle 54 to enter at various angles to accommodate T-connectors in locations otherwise inaccessible to T-connector holding tool 50. For example, an additional hole extending through cylinder 60 having an axis perpendicular to hole 64 and skew to axis 59 can be provided. Additionally, rather than snap connection, a screw connection or other known type of temporary connection may be used.

It is to be understood that the present invention is not limited to the embodiments described above, but encompasses any and all embodiments within the scope of the following claims.

We claim:

1. A T-connector holding tool, comprising:

a handle having a grip portion and a mounting lug extending from the grip portion, wherein said lug has a square drive directly adjacent the grip portion;

wherein said square drive includes a spring-biased ball bearing extending from the square drive;

said mounting lug further including a cylindrical end portion extending from the square drive;

a head having a cylindrical body, the cylindrical body having a bore defined therein, the mounting lug being removably inserted into the bore in order to attach the head to the handle; and first and second claws attached to the cylindrical body in parallel, spaced relation, each of the claws having a pair of jaws dimensioned and configured for simultaneously gripping coaxially aligned nuts of a T-connector in order to prevent rotation of the T-connector when adjusting a nut on stem of the T-connector.

2. The T-connector holding tool according to claim 1, wherein the bore defined in the cylindrical body of said head has a square shaped bottom end having at least one detent hole defined therein, the ball bearing snapping into the detent hole to temporarily secure said head to said handle, and a cylindrically shaped top end receiving the cylindrical end portion of said mounting lug.

3. The T-connector holding tool according to claim 1, wherein each said claw has a smooth, arcuate, cylindrical interior surface.

4. The T-connector holding tool according to claim 1, wherein said bore extends axially through said cylindrical body.

5. The T-connector holding tool according to claim 1, wherein said bore extends transversely through said cylindrical body.

* * * * *